US006603455B1

(12) United States Patent
Zhang et al.

(10) Patent No.: US 6,603,455 B1
(45) Date of Patent: Aug. 5, 2003

(54) DISPLAY PANEL DRIVE CIRCUIT AND DISPLAY PANEL

(75) Inventors: Hongyong Zhang, Kanagawa (JP); Yosuke Tsukamoto, Kanagawa (JP); Yutaka Takafuji, Nara (JP); Yasushi Kubota, Nara (JP)

(73) Assignees: Semiconductor Energy Laboratory Co., Ltd., Kanagawa-ken (JP); Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/176,193

(22) Filed: Oct. 21, 1998

(30) Foreign Application Priority Data

Oct. 28, 1997 (JP) ..... 9-295313

(51) Int. Cl.[7] ..... G09G 3/36
(52) U.S. Cl. ..... 345/100; 345/92; 377/64
(58) Field of Search ..... 345/91, 92, 100, 345/204; 377/64, 70

(56) References Cited

U.S. PATENT DOCUMENTS 5,250,931 A * 10/1993 Misawa et al. ..... 345/206
5,475,396 A * 12/1995 Kitajima et al. ..... 345/92
5,497,146 A * 3/1996 Hebiguchi ..... 345/92
5,808,595 A * 9/1998 Kubota et al. ..... 345/92
5,895,935 A * 4/1999 Yamazaki et al. ..... 257/59
6,022,458 A * 2/2000 Ichikawa ..... 204/192.23

* cited by examiner

*Primary Examiner*—Bipin Shalwala
*Assistant Examiner*—Ricardo Osorio
(74) *Attorney, Agent, or Firm*—Eric J. Robinson; Robinson Intellectual Property Law Office, P.C.

(57) ABSTRACT

A display panel drive circuit and a display panel are provided which are simple in structure but free from initial failure leading to impossibility to perform scanning. The display panel drive circuit of the present invention is structured such that thin film transistors constituting a signal input circuit connected to a circuit outside the display panel are formed in a structure having a dielectric breakdown strength higher than those of thin film transistors constituting other circuits. Specifically, countermeasures are taken by transistor formation in multi-gate structure, gate width broadening, resistance insertion between an input terminal and a transistor or the like. In the present invention, the circuit to which signals are externally inputted or thin film transistors of the same circuit is structured to withstand high voltage, thereby preventing the transistors from being deteriorated by high voltage and occurrence of initial failure while being simple in structure.

10 Claims, 4 Drawing Sheets

DISPLAY PANEL DRIVE CIRCUIT AND DISPLAY PANEL

BACKGROUND OF THE INVENTION

1. Field of the Invention

The present invention relates to a display panel drive circuit and display panel and, more particularly, to a display panel drive circuit and display panel in which thin film transistors for the display panel drive circuit can be prevented from deteriorating.

2. Description of Related Art

In recent years, there have been proposals for LCD (liquid crystal display) panels utilizing low-temperature polysilicon TFTs (thin film transistors). Such display panels can be formed, on one common substrate, not only together with pixel transistors but also with peripheral drive circuits, such as scanning shift registers and sampling circuits. Accordingly, display can be by mere external connection with reduced number of signal lines, reducing the number of parts and improving reliability. Large display panels of an approximately 20–40 type are under considerations.

There are recently found cases where a large color liquid crystal panels is equipped on a camera-integrated video tape recorder (VTR) in order for use as monitors or finders. Of these camera-integrated VTRs, there are structures that a display panel is arranged to rotate about a horizontal axis to shift its position. In such a case, horizontal and vertical scanning directions has to be changed depending upon the panel direction so that display is properly viewed when the panel is rotated. Due to this, the scanning shift register includes a scanning direction control circuit using, for example, an analog switch circuit.

A display panel having a drive circuit for controlling the scanning direction, as mentioned above, was formed on one substrate, for conducting test. It was confirmed that deterioration is encountered in the TFTs of a signal input circuit to which scanning start pulses are externally applied, causing a problem that initial failure occurs resulting in impossibility of scanning.

The cause of such deterioration in the signal input circuit TFTs externally applied by scanning start pulses is to be presumed as follows. That is, the start pulse drive circuit is high in deriveability, and circuit board mounting is separated from the display panel with connections to the display panel through cables, flexible circuit boards or the like. During driving or upon switching the scanning direction, a high voltage occurs due to the effect of interconnection inductance, etc., resulting in deterioration or breakage of transistors. It is also to be presumed as one of reasons for the deterioration that the analog switch circuit, to which an external start pulse is first inputted, is not configured as a gate input circuit.

Also, where the panel is made larger, a problem of time delay occurs particularly for a pixel section. In such a case, there is a necessity of forming the interconnection (gate) with using a low-resistance material such as aluminum. In the above-stated display panel, however, a pixel section and its peripheral circuits are formed by a common process so that the interconnections for the peripheral circuit are formed also by the low-resistance material. Due to this, there has been a problem that the peripheral circuit elements are liable to undergo dielectric breakdown.

Further, where using a high insulation substrate such as a glass substrate, there occurs concentration of electric fields through the interconnections during a plasma process for the TFT manufacture, resulting in a problem that so-called plasma antenna effects occur, i.e., the elements connected to these interconnections undergo damage. This phenomenon is liable to occur, particularly, at end portions of an interconnection pattern, at discontinuous portions or at large electrode areas. This condition is met by a start pulse input terminal pattern.

SUMMARY OF THE INVENTION

It is an object of the present invention to solve the above-stated problems as encountered in the prior art, and to provide a display panel drive circuit and display panel which is simple in structure but is free from occurrence of initial failure leading to impossibility of scanning.

A display panel drive circuit according to the present invention is characterized in that: thin film transistors constituting a signal input circuit connected to a circuit outside the display panel are formed in a structure having a dielectric breakdown strength higher than those of thin film transistors constituting other circuits.

In the present invention, only a circuit to which signals are externally applied or thin film transistors of the same circuit is formed by a structure to withstand high voltage, whereby they operate in a manner preventing against deterioration and hence occurrence of initial failure.

DETAILED DESCRIPTION OF PREFERRED EMBODIMENTS

Figure 1:
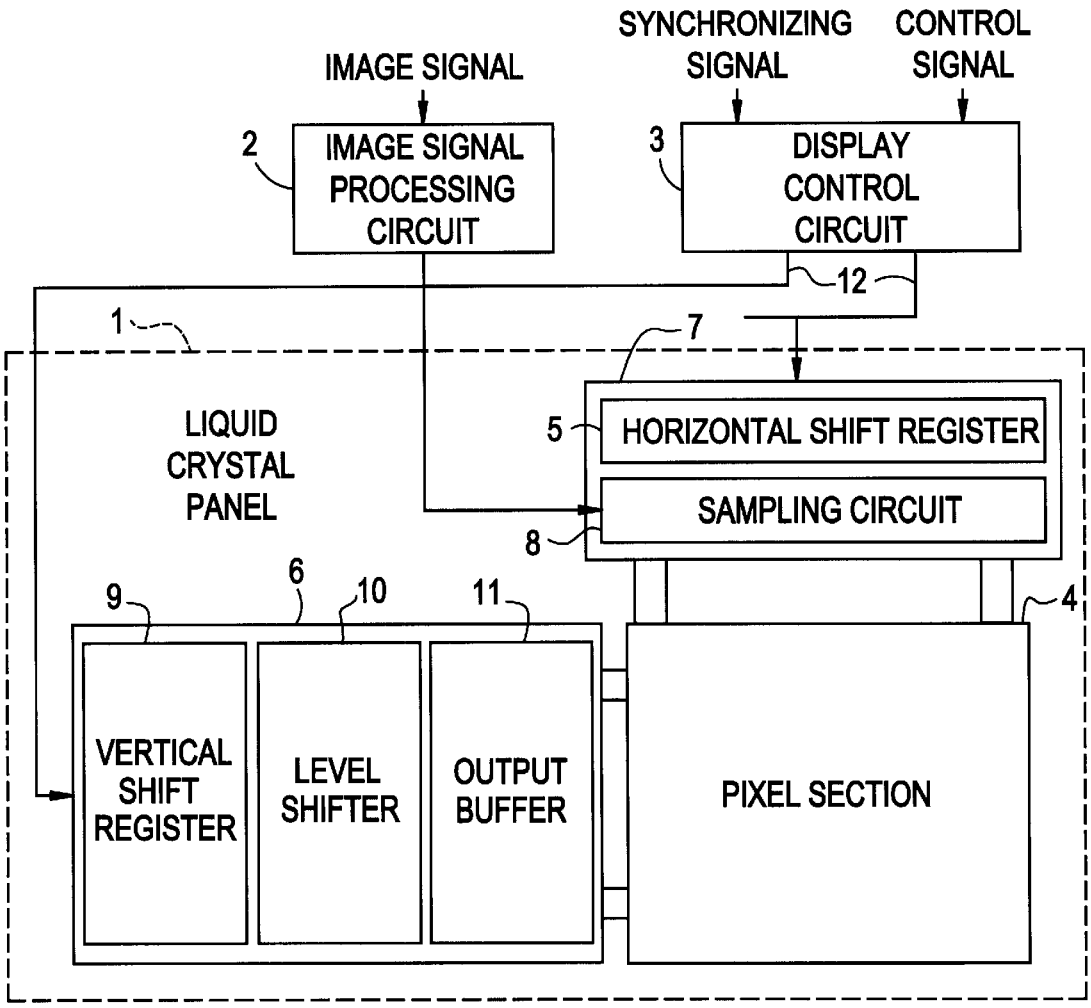
FIG. 1 is a block diagram showing a structure of a liquid crystal panel using low-temperature polysilicon TFTs to which the present invention is applied.

Now preferred embodiments according to the present invention will be described with reference to the drawings. FIG. 1 is a block diagram of a liquid crystal panel utilizing low-temperature polysilicon TFTs to which the present invention is applied. A liquid crystal panel 1 is integrally formed with a pixel section 4 formed by pixel TFTs arranged in a matrix form, and a horizontal scan circuit 5 and vertical scan circuit 6 both formed also by TFTs.

An image signal processing circuit 2 is inputted, for example, with a digital RGB signal to output an analog RGB signal required to drive the pixel section 4. A display control circuit 3 is inputted with an image synchronizing signal and a scan-direction control signal, and controls the horizontal scan circuit 5 and the vertical scan circuit 6. It is noted that the image signal control circuit 2, the display control circuit 3 and the like are mounted, for example, on a separate printed circuit board wherein the circuit board and the liquid crystal panel are connected therebetween through cables, a flexible printed circuit board or the like.

The horizontal scan circuit 5 is formed by a horizontal shift register 7 for controlling the scan direction and a sampling circuit 8 for sampling image signals to drive the pixel section 4. Also, the vertical scan circuit 6 is formed by a vertical shift register 9 for controlling the scan direction, a level shifter for controlling an output signal of the shift register 9 into a voltage required to drive the pixel section 4, and an output buffer 11.

Figure 3:
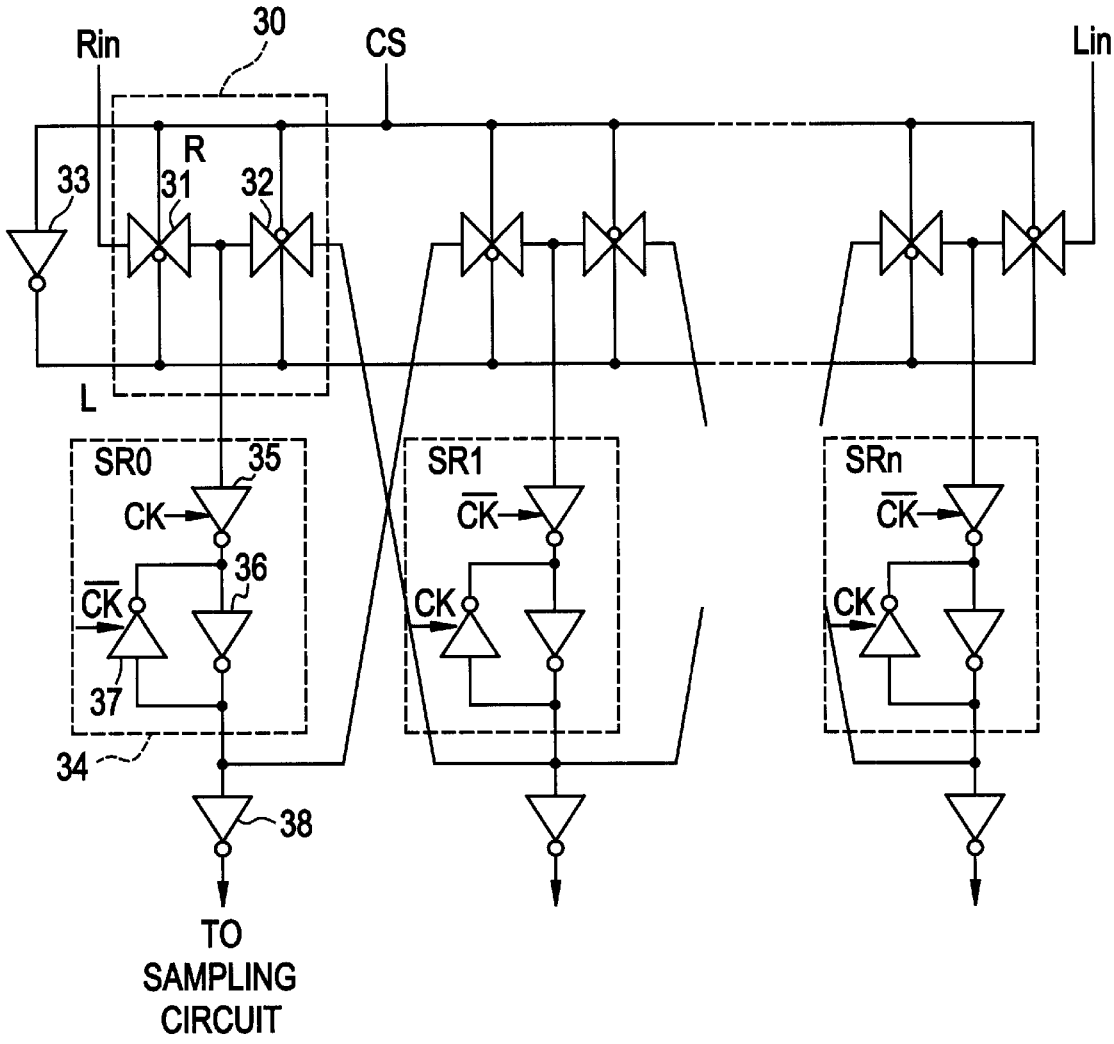
FIG. 3 is a circuit diagram showing a circuit configuration of a horizontal shift register 7 in FIG. 1.

FIG. 3 is a circuit diagram showing a circuit configuration of the horizontal shift register in FIG. 1. The shift register circuit is inputted with a scan direction control signal CS (1: right, 0: left), right and left scan start pulse signals Rin and Lin, and a scan clock signal CK from the display control circuit 3 so that it outputs a sample pulse to the sampling circuit 8 to perform scanning in a direction dependent upon CS.

The shift register circuit, corresponding to one pixel, is formed by a scan direction control circuit 30, a shift register circuit 34 and an inverter 38 for driving the sampling circuit. The scanning direction control circuit 30 has two analog switches 31, 32. The analog switch 31, on the left end, has an input terminal to which a right scan start pulse signal Rin is inputted. Also, the analog switch 32 has an input terminal connected to an output line of a shift register circuit SR1 on the right side. The two analog switches 31, 32 have their controlled terminals to which direction control signal R (=CS) and L (=inverted signal to CS) are respectively connected so that when one switch is on the other switch is in an off state.

The two analog switches 31, 32 has their output terminals connected together and inputted to an inverter 35 of the shift register circuit SR0 (34). The inverter 35 has a controlled terminal, so that it functions as a normal inverter when the controlled terminal is at 1 while its output terminal is in a high impedance state and disconnected from the input when the controlled terminal is at 0. The output of the inverter 35 is inputted to an inverter 36. The inverter 36 has an output inputted to a drive inverter 38 and also connected to an inverter 37 and an analog switch on the right side. The inverter 37 has an output connected to the input of the inverter 36.

A positive-phase clock signal CK is inputted to the controlled terminal of the inverter 35 of the right-end shift register circuit SR0, while a reverse-phase clock signal CK is inputted to the controlled terminal of the inverter 37. In the right-side shift register circuit SR1, clock signals reverse in phase to those of SR0 are inputted respectively to the controlled terminals of the inverters. In this manner, the shift register circuits, on every odd and even numbers, are inputted with clock signals reverse in phase.

It is now assumed that, where CS is at 1 (scanning in the right direction), that is, where the switch 31 is on and the switch 32 is off, Rin is applied by a start pulse. In the shift register circuit SR0, during time period 1 in the clock CK a pulse (1) reaches the input terminal of the inverter 38 through the analog switch 31. During a next time period 0 in the clock CK the inverter 35 becomes a high impedance state to hold a state 1 by the inverter 36 and the inverter 37.

In the right-side shift register SR1, during a time period 0 in the clock CK the output signal of the shift register circuit SRO reaches its output end, and a next clock CK is held during a time period 1. The above operation is repeated on each inversion of the clock CK so that start pulses go through the shift register circuit with shifting on every half period of the clock CK. Thus the pulses of one clock CK period is outputted to each sampling circuit.

Figure 2:
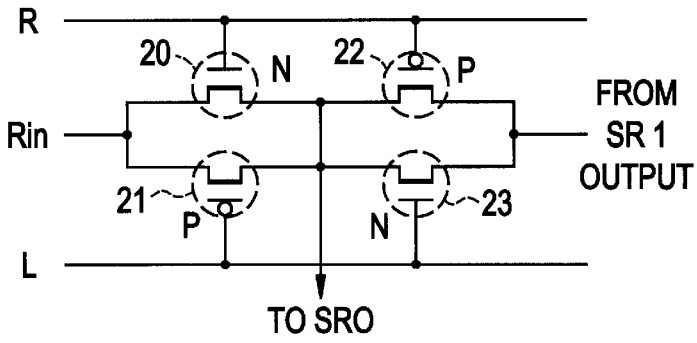
FIG. 2 PRIOR ART
FIG. 2 is a circuit diagram showing a structure of a conventional scanning direction control circuit 30.

FIG. 2 is a circuit diagram showing a configuration of a conventional scanning direction control circuit 30. The scanning direction control circuit 30 is formed by two analog switches 31, 32. The analog switch 31 is configured by FETs 20, 21, while the analog switch 31 is by FETs 22, 23. The FET 20 is an N-channel MOSFET, a gate of which is connected to a control line R. The FET 21 having an inversion circle at its gate is a P-channel MOSFET, a gate of which is connected to a control line L. The analog switch 32, formed by the FET 22, 23, is structured reverse in polarity to the analog switch 31 with respect to the vertically-arranged FETs.

Where the control line is at 1, L is at 0. Consequently, the FETs 20 and 21 becomes an on state and the FETs 22 and 23 an off state so that the signal line Rin is brought into connection to the shift register circuit R0. Also, where the control line R is at 0 (L is at 1), the FETs 22 and 23 turn on so that the output signal of the SR1 is connected to the SR0.

Now if an overvoltage is applied, for example, through the signal input terminal Rin, it is to be presumed that the FET 20 or 21 be deteriorated in characteristic or broken down causing an initial failure impossible to perform scanning. In order to prevent this, the present invention takes a measure provide a high breakdown strength structure to the FETs at the relevant portion.

Figure 6:
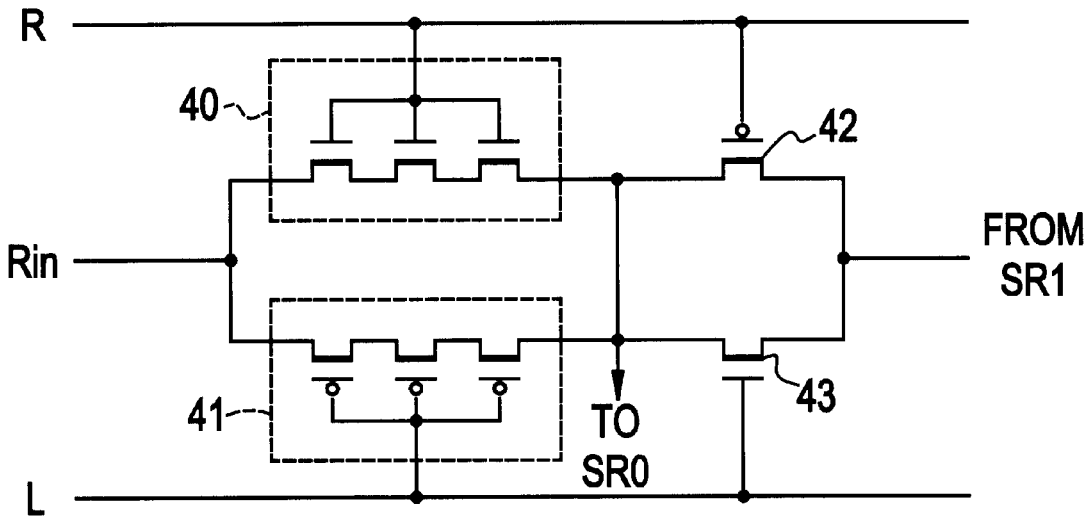
FIG. 6 is a circuit diagram showing a circuit configuration at an end portion of a scanning direction control circuit in the first embodiment.

FIG. 6 is a circuit diagram showing a circuit configuration at an end portion of the scan direction control circuit in the first embodiment. In the first embodiment, a multi-gate structure is provided for FETs 40, 41 constituting an analog switch as a signal input circuit for the control line Rin. Thus a high breakdown strength structure is provided equivalent to a structure having a plurality of FETs with their sources and drains connected in series. By adopting such a structure, where a high voltage is applied to the control line Rin, the FETs corresponding to respective gate areas are applied by divisional voltages, thus reducing the possibility of deterioration or breakdown to occur.

Figure 4:
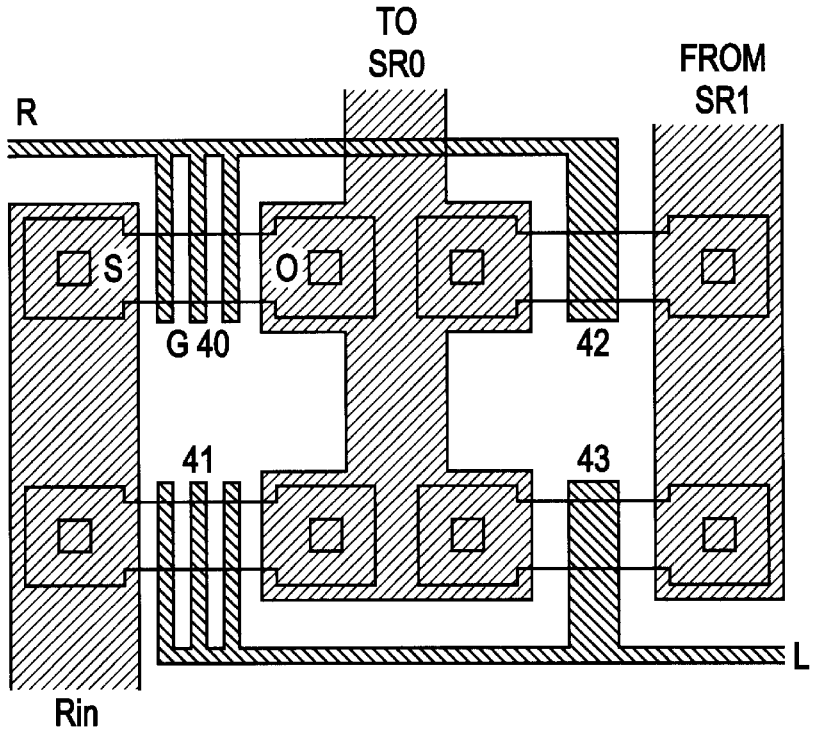
FIG. 4 is an explanatory view showing a pattern structure of an integrated circuit corresponding to FIG. 6.

FIG. 4 is an explanatory view showing a pattern structure of an integrated circuit corresponding to the circuit diagram of FIG. 6. There are FET 40 at upper left in FIG. 4 and FET 41 at lower left, which are in high-breakdown strength structures each having an electrode pattern with three gates. Note that the number of the gates may adopt an arbitrary number of two or more.

Such FETs can be manufactured in a process similar to that of the conventional. For example, the following process may be applied as a manufacture process for top-gate polysilicon TFTs. Quartz, for example, is adopted as a substrate to first form an amorphous silicon film thereon. Then the amorphous silicon film is crystallized. Thereafter an island-form semiconductor layer is formed, and a silicon oxide film is formed thereon as a gate dielectric film.

Then an aluminum film for a gate electrode is formed to provide an electrode pattern. Thereafter anode oxidation is made, and the silicon oxide film is etched. Then impurity ions are added through forming masks to form an n− region, p− region, and further n+ region, p+ region. By the above process, all active layers are completed. Then thermal treatment is made to perform impurity ion activation. Insulation interlayers are formed, and source interconnections and drain interconnections are formed, thus completing the process.

Figure 5:
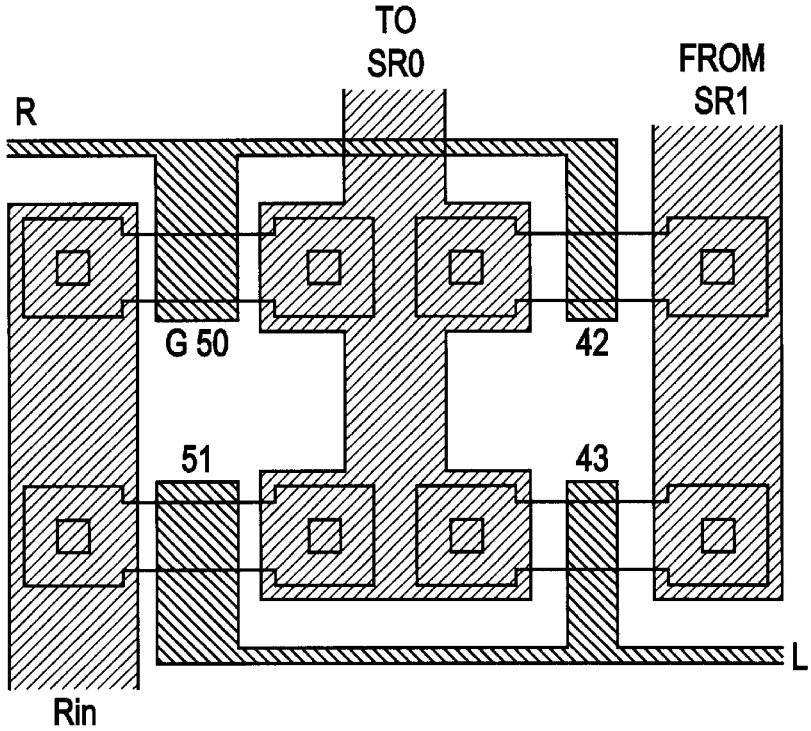
FIG. 5 is an explanatory view showing a pattern structure of an integrated circuit according to a second embodiment.

FIG. 5 is an explanatory view showing a pattern configuration in a second embodiment. Although the first embodiment was increased in breakdown strength by the multi-gate structure, the second embodiment is attempted to increase the breakdown strength by broadening the gate electrode pattern width in order to moderate the voltage gradient in the gate area. In FIG. 5, there are FET 50 at upper left and FET 51 at lower left, which constitute an analog switch as an input circuit for the control line Rin, are broader in electrode pattern width than those of other FETs to form a high breakdown strength structure.

Figure 7:
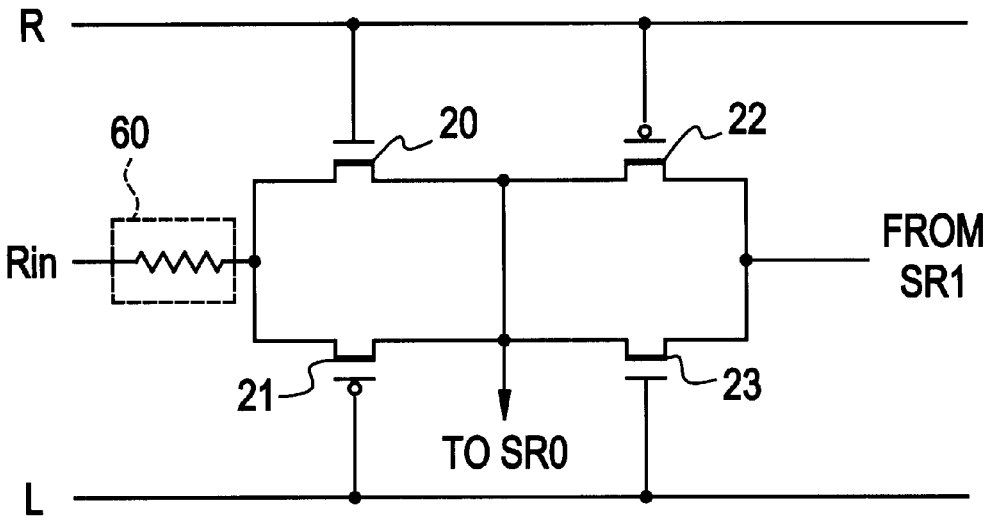
FIG. 7 is a circuit diagram showing a structure according to a third embodiment.

FIG. 7 is a circuit diagram showing a structure of a third embodiment. In the third embodiment, a resistance is inserted between FETs 20, 21 forming an input circuit and an input terminal for a signal Rin. The resistance value adopts a value as great as possible within an extent free from waveform deformation. It is possible to form this resistance simultaneous with the TFTs during the TFT manufacture process.

In the above, three embodiments were explained which are intended to increase the breakdown strength for the analog switch circuit as an input circuit. Where utilized in applications that inversion of scan direction is not required, the analog switch circuit for controlling the scan direction is unnecessary and the shift register circuit at an end portion thereof serves as a signal input circuit. In such a case, there is a necessity of increasing the breakdown strength for the signal input circuit at the end portion of the shift register circuit. In also this case, a high breakdown strength structure, such as multi-gate formation, increased gate width and resistance insertion, is adopted as countermeasure.

Further, in the circuit configuration of FIG. 3, where a high voltage is applied to the signal terminal Rin for example when the analog switch 31 is on, there is a fear that a high voltage be applied to the inverter 35 of the shift register SR0 or the analog switch 32 on the other side. However, initial failure is positively prevented by adopting a high breakdown strength structure not only for the signal input circuit at the end portion but for the several-stage deeper circuits connected therewith.

Although the embodiments were explained hereinabove, modifications are to be further contemplated as follows. As a high breakdown strength structure, countermeasures can be taken that include buffer gate circuit insertion, low-pass characteristic filter circuit insertion or capacitance addition, diode series circuit, Zener diode, other overvoltage absorbing element addition, and voltage division with resistance, besides multi-gate formation, gate width increase and resistance insertion. Various countermeasures may be combined.

As stated above, in the preset invention only a circuit to which signals are externally inputted or thin film transistors of the same circuit is structured to withstand high voltage. This offers effects that the elements are prevented from being deteriorated due to externally induced high voltage drive pulses, static electricity or high voltage caused by a plasma antenna effect, thus providing a display panel drive circuit and a display panel free from initial failure leading to impossibility to effect scanning. Also, the structure is simple, and there is almost no increase in circuit area. Further, there is another effect that the manufacturing may be by a process similar to that of the conventional without complicating the manufacture process.

What is claimed is:

1. A display device comprising:

a plurality of serially connected shift register circuits provided over a substrate;

a plurality of analog switches provided over said substrate, said plurality of analog switches connected with end parts of said plurality of shift register circuits; and a control circuit for inputting a start pulse signal into at least one of said plurality of shift register circuits through at least one of said plurality of analog switches, said control circuit provided outside said substrate;

wherein said plurality of shift register circuits comprise a first thin film transistor and said plurality of analog switches comprise a second thin film transistor, wherein one of source and drain regions of said second thin film transistor is connected with said control circuit, and wherein said second thin film transistor is formed in a structure having a breakdown strength higher than that of said first thin film transistor.

2. A device according to claim 1, wherein said high breakdown strength structure is formed by a multi-gate structure.

3. A device according to claim 1, wherein said second thin film transistor has a gate width broader than that of said first thin film transistor.

4. A display device comprising:

a plurality of pixels provided over a substrate, said plurality of pixels comprising a first thin film transistor;

a plurality of serially connected shift register circuits;

a plurality of analog switches provided over said substrate, said plurality of analog switches connected with end parts of said plurality of shift register circuits;

a control circuit for inputting a start pulse signal into at least one of said plurality of shift register circuits through at least one of said plurality of analog switches, said control circuit provided outside said substrate; and resistance provided between at least one of said plurality of analog switches and a signal input terminal on said substrate, said signal input terminal connected with said control circuit, wherein said plurality of analog switches comprise a second thin film transistor, wherein one of source and drain regions of said second thin film transistor is connected with said control circuit.

5. A display device comprising:

a plurality of pixels provided over a substrate, said plurality of pixels comprising a first thin film transistor;

plurality of serially connected shift register circuits comprising a second thin film transistor provided over said substrate;

plurality of analog switches provided over said substrate, said plurality of analog switches connected with end parts of said plurality of shift register circuits; and a control circuit for inputting a start pulse signal into at least one of said plurality of shift register circuit through at least one of said plurality of analog switches, said control circuit provided outside said substrate;

wherein said plurality of analog switches comprise a third thin film transistor, wherein one of source and drain regions of said third thin film transistor is connected with said control circuit, and wherein said third thin film transistor is formed in a structure having a breakdown strength higher than those of said first and second thin film transistors.

6. A device according to claim 5, wherein said high breakdown strength structure is formed by a multi-gate structure.

7. A device according to claim 5, wherein said third thin film transistor has a gate width broader than that of said first and second thin film transistors.

8. A display device comprising:

a plurality of series connected shift register circuits provided over a substrate, each of the shift register circuits having a terminal to receive a start pulse signal;

a plurality of analog switches connected to said terminal of the respective shift register circuits wherein said start pulse signal is input to said terminal through corresponding one of the analog switches;

wherein each of said plurality of shift register circuitsi-comprises a first thin film transistor formed over the substrate and each of said plurality of analog switches comprises a second thin film transistor formed over the substrate, and wherein said second thin film transistor has a higher breakdown strength structure than said first thin film transistor.

9. A device according to claim 8, wherein said higher breakdown strength structure is formed by a multi-gate structure.

10. A device according to claim 8, wherein said second thin film transistor has a gate width broader than that of said first thin film transistor.

* * * * *